US007165348B1

(12) United States Patent
Ward

(10) Patent No.: US 7,165,348 B1
(45) Date of Patent: Jan. 23, 2007

(54) METHODS AND APPARATUS FOR LIMITING ATTACHMENT ACCESS TO A PLOW

(76) Inventor: Kelly E. Ward, 7 Beechwood Rd., Sandown, NH (US) 03865

( * ) Notice: Subject to any disclaimer, the term of this patent is extended or adjusted under 35 U.S.C. 154(b) by 0 days.

(21) Appl. No.: 10/852,851

(22) Filed: May 25, 2004

Related U.S. Application Data

(60) Provisional application No. 60/526,507, filed on Dec. 3, 2003.

(51) Int. Cl.
*B65D 55/14* (2006.01)

(52) U.S. Cl. ..... 37/466; 70/164; 280/507

(58) Field of Classification Search ..... 37/266, 37/264, 466; 172/811, 817; 70/164, 163, 70/158, 14; 280/507
See application file for complete search history.

(56) References Cited

U.S. PATENT DOCUMENTS 4,962,599 A * 10/1990 Harris ..... 37/266
5,265,355 A * 11/1993 Daniels ..... 37/231
5,441,295 A * 8/1995 Smith ..... 280/507
5,520,030 A * 5/1996 Muldoon ..... 70/14
5,724,839 A * 3/1998 Thering ..... 70/18
5,927,108 A * 7/1999 Pierce ..... 70/19
6,202,328 B1 * 3/2001 Fulton ..... 37/231
6,240,792 B1 * 6/2001 Elsesser ..... 73/865.9
6,412,313 B1 * 7/2002 Bernstrom ..... 70/14
6,598,432 B1 * 7/2003 Dwyer ..... 70/14
6,619,708 B1 * 9/2003 Naylor ..... 292/259 R
6,829,914 B1 * 12/2004 Bullock ..... 70/14

* cited by examiner

*Primary Examiner*—Victor Batson
(74) *Attorney, Agent, or Firm*—Chapin IP Law, LLC; Barry W. Chapin, Esq.

(57) ABSTRACT

A plow security device, configured in accordance with embodiments of the invention, includes an attachment assembly that corresponds to a headgear assembly, or mounting portions, of a plow. During operation, a user couples the attachment assembly of the plow security device to the mounting portions of the plow. The user secures the plow security device to the plow such that the attachment assembly blocks or limits an unauthorized user from accessing the mounting portions of the plow and coupling the plow to an unauthorized vehicle. The plow security device, therefore, minimizes an unauthorized user from attaching a vehicle to the plow and removing the plow from a storage location.

12 Claims, 7 Drawing Sheets

METHODS AND APPARATUS FOR LIMITING ATTACHMENT ACCESS TO A PLOW

RELATED APPLICATIONS

This application claims benefit of U.S. Provisional Application Ser. No. 60/526,507 filed Dec. 3, 2003, the entire teachings of which are incorporated herein by reference.

BACKGROUND

Vehicles, such as pickup trucks, utilize vehicle accessories, such as plows fitted on the vehicles, for moving snow, dirt, sand, gravel, or other plowable materials. In certain cases, such as when the vehicle is to be used for purposes other than plowing, a vehicle owner may want to remove the plow from the vehicle. Conventional plow assemblies, such as snowplow assemblies, include a mechanism that allows attachment and detachment of the plow assembly to the vehicle.

Conventional detachable plow assemblies generally provide a mount frame for permanent attachment to a frame of the vehicle, a plow having a plow frame (e.g., an A-frame), and an actuator coupled between the mount frame and the plow frame for raising and lowering the plow. The mount frame and actuator attach to the front end of the vehicle, typically behind the vehicle's front bumper. The plow frame (e.g., the A-frame) of the plow includes a headgear assembly, or mounting portions, that attach to the mount frame and the actuator in a removable manner. For example, certain conventional headgear assemblies include a pin arrangement (e.g., a pair of retention pins) that couples the headgear assembly of the plow to the vehicle. In another example, certain conventional headgear assemblies include a latching mechanism having pair of spaced hooks pivotally coupled to the headgear assembly. The latching mechanism of the headgear assembly engages and couples to the mount frame of a vehicle. Such attachment arrangements allow a user to attach the plow to a vehicle and remove the plow from the vehicle when not in use.

When a user detaches the plow from the vehicle, typically, the user stores the plow in a manner that minimizes or prevents unauthorized use or theft of the plow. For example, the user can store the plow in a garage or other enclosed, secure location to limit access to the plow. In another example, the user can store the plow in an open (e.g., outdoor) location and secure the plow by chaining and locking the plow to a relatively large object, such as a tree.

SUMMARY

Conventional mechanisms and techniques for storing a plow while minimizing unauthorized access to the plow suffer from a variety of deficiencies.

As indicated above, when a user detaches the plow from the vehicle, the user can store the plow in a garage or other enclosed, secure location to limit access to the plow. Such storage, however, requires the user to have space available (e.g., such as a garage). Maintenance or rental of the space for plow storage can become prohibitively expensive.

Also as indicated above, when a user detaches the plow from the vehicle, the user can store the plow in an open (e.g., outdoor) location. With such storage, however, the headgear assembly or mounting portions of the plow are typically exposed for attachment to a mount frame of a vehicle, thereby putting the plow at risk for unauthorized access or theft. For example, when a user stores the plow in an outdoor location, an unauthorized user can attach a vehicle (e.g., a vehicle having a mount frame compatible with the headgear assembly of the plow) to the plow and remove the plow from the storage location. In the case where the user secures the plow by chaining and locking the plow to a relatively large object, such as a tree, an unauthorized user can use bolt cutters to break the chain and access the plow via the exposed mounting portions of the plow.

By contrast, embodiments of the present invention significantly overcome the described deficiencies and provide mechanisms and techniques for securing and minimizing unauthorized access to a plow. A plow security device, configured in accordance with embodiments of the invention, includes an attachment assembly that corresponds to a headgear assembly, or mounting portions, of a plow. During operation, a user couples the attachment assembly of the plow security device to the mounting portions of the plow. The user secures the plow security device to the plow such that the attachment assembly blocks or limits an unauthorized user from accessing the mounting portions of the plow and coupling the plow to an unauthorized vehicle. The plow security device, therefore, minimizes an unauthorized user from attaching a vehicle to the plow and removing the plow from a storage location.

In one arrangement, a plow security device includes an attachment assembly configured to engage a mounting portion of a plow and minimize attachment access to the mounting portion of the plow. The plow security device also includes a fixation adaptor in communication with the attachment assembly, the fixation adaptor configured to secure the attachment assembly to the plow. The attachment assembly and fixation adaptor effectively "blocks" an unauthorized user from attaching a mount frame of a plow vehicle to the mounting portion of the plow. As such, the plow security device minimizes unauthorized use or theft of the plow.

In one arrangement, the plow security device has a housing coupled to the attachment assembly where the housing includes a fixation adaptor shield oriented in proximity to the fixation adaptor. The fixation adaptor shield limits the ability for an unauthorized user to destroy the fixation adaptor (e.g., or a lock associated with the fixation adaptor) using a hammering device, such as a sledgehammer, and thereby provides a level of security to the security device.

In one arrangement, the plow security device includes a first mounting element coupled to the housing where the first mounting element configured to engage the mounting portion of the plow. Such engagement effectively blocks an unauthorized user's access to the mounting portion of the plow, for example. The plow security device also includes a second mounting element in movable communication with the housing, where the second mounting element is configured to position in proximity to the mounting portion of the plow. In such an arrangement, the second mounting element acts as a cover or shield for the mounting portion of the plow, thereby further limiting an unauthorized user's access to the mounting portion of the plow.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the present invention provide mechanisms and techniques for securing and minimizing unauthorized access to a plow. A plow security device, configured in accordance with embodiments of the invention, includes an attachment assembly that corresponds to a headgear assembly, or mounting portions, of a plow. During operation, a user couples the attachment assembly of the plow security device to the mounting portions of the plow. The user secures the plow security device to the plow such that the attachment assembly blocks or limits an unauthorized user from accessing the mounting portions of the plow and coupling the plow to an unauthorized vehicle. The plow security device, therefore, minimizes an unauthorized user from attaching a vehicle to the plow and removing the plow from a storage location.

Figure 1:
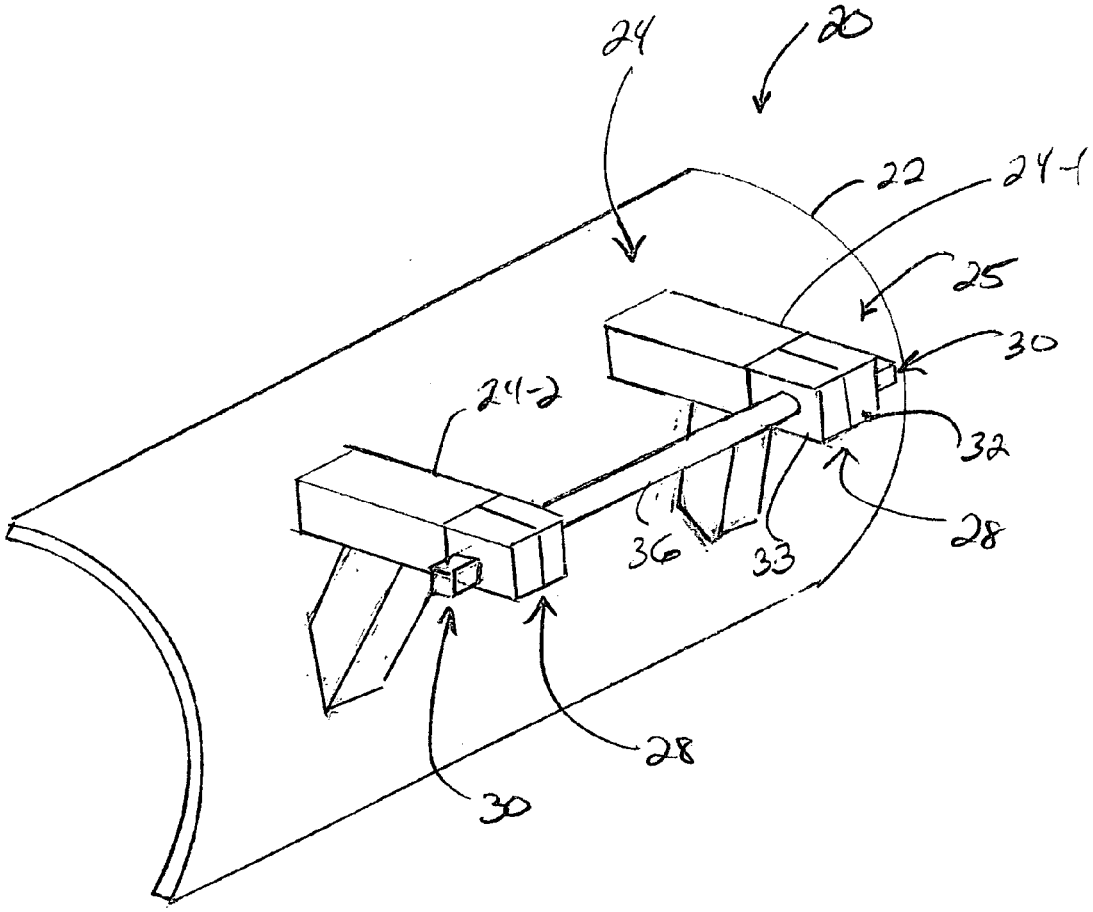
FIG. 1 is a perspective view of a schematic representation of a plow security system.

FIG. 1 illustrates a schematic of a plow security system 20, according to one arrangement. The plow security system 20 includes a plow 22 having a plow mounting portion 24 and a plow security device 25 coupled to the plow mounting portion 24.

As illustrated, the plow mounting portion 24 includes a first plow mounting portion 24-1 and a second plow mounting portion 24-2. The plow mounting portions 24-1, 24-2 are configured engage and attach with a corresponding mount frame, such as a mount frame of a plow vehicle (e.g., a mount frame attached to a pickup truck). For example, in one arrangement, the plow mounting portions 24-1, 24-2 include a pin arrangement (e.g., a pair of retention pins) that couples the plow 22 to a vehicle. In another arrangement, the plow mounting portions 24-1, 24-2 include a latching mechanism that couples the plow 22 to a vehicle.

The plow security device 25 is configured to attach to the plow mounting portion 24 of the plow 22 to limit or prevent an unauthorized user from attaching an unauthorized vehicle (e.g., a vehicle having a corresponding vehicle mounting frame) to the plow mounting portions 24 of the plow 22. As such, the plow security device 25 minimizes unauthorized use or theft of the plow 22. The plow security device 25, in one arrangement, includes an attachment assembly 28 and a fixation adaptor 30.

The attachment assembly 28 is configured to engage the plow mounting portion 24 to limit an unauthorized user's access to the plow mounting portion 24. The attachment assembly 28 effectively "blocks" an unauthorized user from attaching a mount frame of a plow vehicle to the mounting portion 24 of the plow 22. In one arrangement, the attachment assembly 28 includes a first mounting element 32 and a second mounting element 33. The first mounting element 32, in one arrangement, attaches to a housing 36 and is configured to engage the mounting portion 24 of the plow 22. Such engagement effectively blocks an unauthorized user's access to the mounting portion 24, for example. The second mounting element 33 moves relative to the first mounting element 32 (e.g., or relative to the housing 36 of the plow security device 25) and is configured to position in proximity to the mounting portion 24 of the plow 22. The second mounting element 33, in such an arrangement, acts as a cover or shield for the mounting portion 24 of the plow 22, thereby further limiting an unauthorized user's access to the mounting portion 24 of the plow 22.

The fixation adaptor 30 is configured to secure the plow security device 25 to the plow 22 and to maintain the attachment assembly 28 in an engaged state relative to the plow mounting portion 24 of the plow 22, thereby limiting unauthorized removal of the plow security device 25 from the plow 22. The fixation adaptor 30, in one arrangement, defines an opening configured to receive a locking element, such as a padlock, to secure the plow security device 25 to the plow 22. In another arrangement, the fixation adaptor 30 is configured as a lock integrally formed with the attachment assembly 28 that, when engaged, secures the plow security device 25 to the plow 22.

Figure 2:
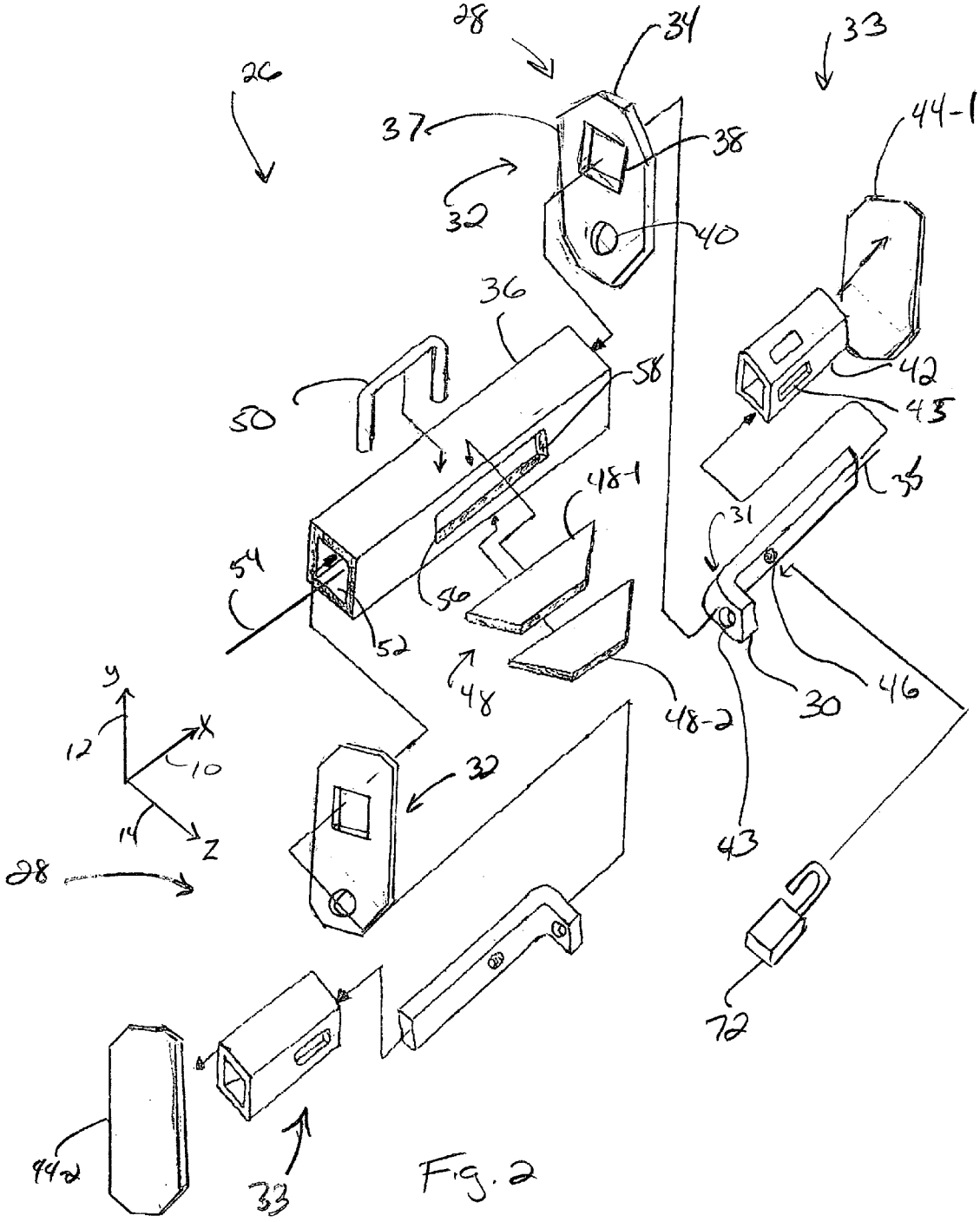
FIG. 2 illustrates an assembly view of a plow security system, according to one embodiment of the invention.

FIG. 2 illustrates an arrangement of a plow security device 25 where the plow security device 26 is configured to secure a plow 22 having a pin-type coupling mechanism (e.g., a pair of retention pins) as the mounting portion 24. For example, the plow security device 26 is configured to attach and secure to a FISHER MINUTE MOUNT plow (Fisher Engineering, Rockport, Me.). The plow security device 26, taken in conjunction with the plow 22 illustrated in FIG. 1, includes a housing 36, an attachment assembly 28 having a first mounting element 32 and a second mounting element 33, and a fixation adaptor 30.

The first mounting element 32 of the attachment assembly 28, in one arrangement, is an adaptor element 37 configured to engage a pin-type coupling mechanism of the plow 22. The adaptor element 37 includes a plate, such as a steel plate having the thickness between approximately ¼ and ⅜ inches, that defines an attachment opening 38 and a coupling opening 40. In one arrangement, the coupling opening 40 is configured to receive a pin-type coupling mechanism of a plow 22 to couple the plow security device 26 to the plow mounting portion 24, as described in detail below.

The attachment opening 38 of the adaptor element 37 has a cross-sectional area greater than or equal to a cross-sectional area defined by the housing 36. Such a cross-sectional area allows a manufacturer to customize the configuration of the plow security device 26 (e.g., the relative location of the adaptor element 37) based upon the location of the corresponding mounting portions 24 for a particular manufacturer's plow 22. For example, during assembly, the housing 36 inserts within the attachment opening 38 of the adaptor element 37. A manufacturer then slides the adaptor element 37 along a long axis 54 of the housing 36 to position the coupling opening 40, defined by the adaptor plate 37, relative to the mounting portions 24 of a particular plow 22. The manufacturer then secures the adaptor element 37 to the housing 36, such as by a weld connection.

The second mounting element 33 of the plow security device 26 includes a support member 42 and blocking element 44. In one arrangement, the blocking element 44 is formed of a steel plate having the thickness between approximately ¼ and ⅜ inches. As described below, the blocking element 44 acts as a cover or shield for the mounting portion 24 of the plow 22 to limit an unauthorized user's access to the mounting portion 24 of the plow 22. The support member 42 attaches to the blocking element 44, such as by a weld connection, and is configured to position the blocking element 44 relative to the adaptor element 37 during operation. The support member 42, for example, is formed of a 1.5 inch square steel tube having a length of approximately 8 inches, in one arrangement, and inserts within an opening 52 defined by the housing 36 and slides within the opening 52 along a long axis 54 of the housing 36.

As indicated above, the fixation adaptor 30 is configured to secure the plow security device 26 to the mounting portion 24 of the plow 22. In one arrangement, the fixation adaptor 30 forms part of the second mounting element 33. For example, the fixation adaptor 30 couples to the support member 42 by a plug weld. As shown by FIG. 2, the fixation adaptor 30 is configured as a bar or rod having, in one arrangement, a width of approximately 1 inch, a thickness of approximately 0.5 inches, and a length of approximately 23 inches. The fixation adaptor has a fixation portion 31 oriented angle relative to a long axis 35 of the fixation adaptor 30. The fixation portion 31 defines an opening 43 configured to receive a lock 72 for example to secure the plow security device 26 to the plow 22. In one arrangement, the lock 72 is a shrouded padlock having a shrouded body that limits an unauthorized user from prying or cutting the padlock. In one arrangement, the shrouded padlock is a Master Lock padlock model number 187XD (Master Lock Company).

During assembly, a manufacturer inserts the fixation adaptor 30 and support member 42 within the opening 52 of the housing 36 such that the angled fixation portion 31 protrudes through the housing 36 via a fastener opening 56 defined by the housing 36. Such an arrangement provides an operator access to the fixation portion 31 of the fixation mechanism 30 (e.g., to lock or unlock the fixation mechanism 30).

In one arrangement, the manufacturer secures the second mounting element 33 within the housing 36 using a stopper or shoulder bolt 46, such as a ⅜"-16 shoulder bolt. For example, the manufacturer places the shoulder bolt 46 through the fastener opening 56 defined by the housing 36 (e.g., having dimensions of approximately 1 inch in width and 14.5 inches in length) and through an opening 45 defined by the support member 42. The manufacturer engages the fixation mechanism 30 with the shoulder bolt 46 such that the shoulder bolt 46 contacts a housing wall 58 that defines the fastener opening 56. Such contact minimizes removal of the second mounting element 33-1 from the housing 36 (e.g., when the plow security device is in an unengaged state) and provides a limited rage of sliding motion of the second mounting element 33-1 along the long axis 54 within the housing 36.

The housing 36, in one arrangement, is formed of a square steel tube having a width of approximately 2 inches, a wall thickness of approximately 3/16 inches, and a length of approximately 40 inches. Such a geometric configuration provides rigidity to the plow security device 26 and, when coupled to plow mounting portions 24 of a plow 22, minimizes an unauthorized user from cutting or detaching the plow security system 20 from the plow 22.

In one arrangement, the housing 36 includes a fixation adaptor shield 48 oriented in proximity to the fixation adaptor 30. In one arrangement, the fixation adaptor shield 48 is configured to protect the fixation adaptor 30 or a lock 72 associated with the fixation adaptor 30 from exposure to the elements (e.g., snow and ice), thereby limiting the failure of the fixation adaptor 30 or lock 72 as caused by corrosion. In another arrangement, the fixation adaptor shield 48 is configured to protect the fixation adaptor 30, or a lock 72 associated with the fixation adaptor 30, from unauthorized access. For example, the fixation adaptor shield 48 is formed from a steel plate having a length of approximately 16 inches and a width of approximately 3 inches. The material and geometry of the fixation adaptor shield 48 limits the ability for an unauthorized user to destroy the fixation adaptor 30 (e.g., or the lock 72 associated with the fixation adaptor 30) using a hammering device such as a sledgehammer and thereby provides a level of security to the security device 26.

In one arrangement, the fixation adaptor shield 48 includes a first shield element 48-1 and a second shield element 48-2 where the second shied element 48-2 couples to the housing such that the second shield element 48-2 opposes the first shield element 48-1 and orients substantially parallel to the first shield element 48-1. In such a configuration, the first shield element 48-1 and a second shield element 48-2 surround the fixation adaptor 30 and protect the fixation adaptor 30, or the lock 72 associated with the fixation adaptor 30, from access by a set of lock cutters or bolt cutters. The first shield element 48-1 and a second shield element 48-2, therefore, provide additional security to the plow 22 via the plow security device 26.

FIGS. 3 through 6 illustrate an example of an installation of the plow security device 26 onto a plow 22 (e.g., a plow mounting portion 24). For example, FIGS. 3 through 6 illustrate installation of the plow security device 26 onto a FISHER MINUTE MOUNT plow (Fisher Engineering, Rockport, Me.).

Figure 3:
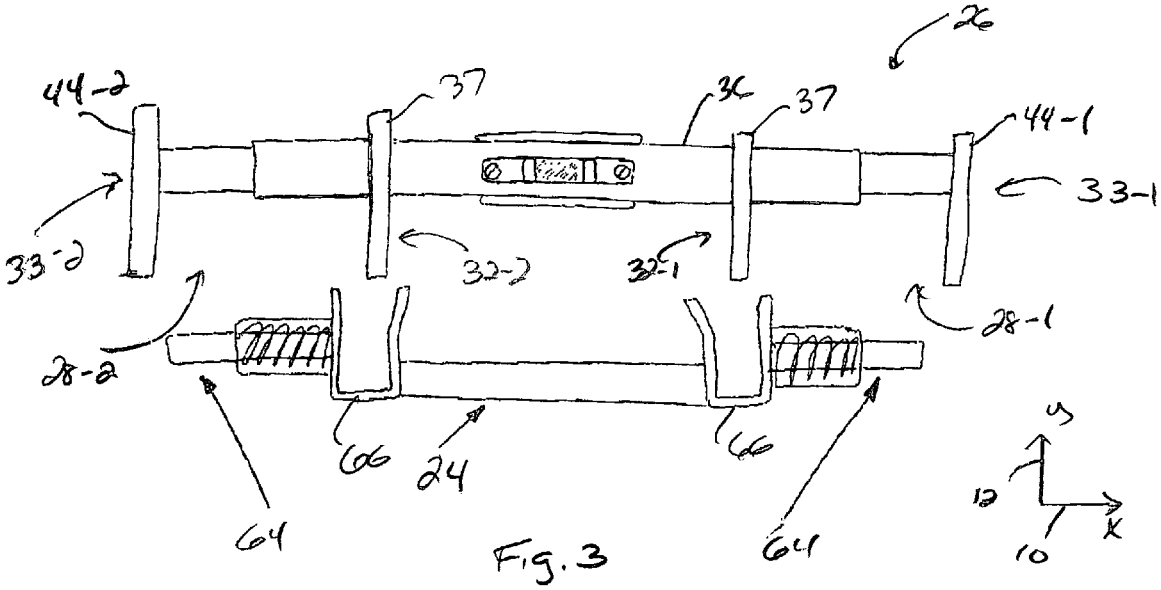
FIG. 3 illustrates attachment of the plow security device of FIG. 2 to a plow, according to one embodiment of the invention.

In FIG. 3, an operator aligns the attachment assemblies 28 of the plow security device 26 with a mounting portion 24 of a plow 22. For example, the operator first positions (e.g., extends) pins 64 associated with the mounting portion 24 of the plow 22 to allow insertion of the first mounting elements 32-1, 32-2 within corresponding couplers or brackets 66 of the plow mounting portion 24 of the plow 22. The operator then extends the second mounting elements 33-1, 33-2 of the plow security device 26 (e.g., sliding the support members 42 within the opening 52 of the housing 36 away from a center portion of the housing 36) to provide clearance of the second mounting elements 33-1, 33-2 relative to the extended pins 64. The operator then aligns the first mounting elements 32-1, 32-2 with corresponding brackets 66 of the mounting portion 24 of the plow 22.

Figure 4:
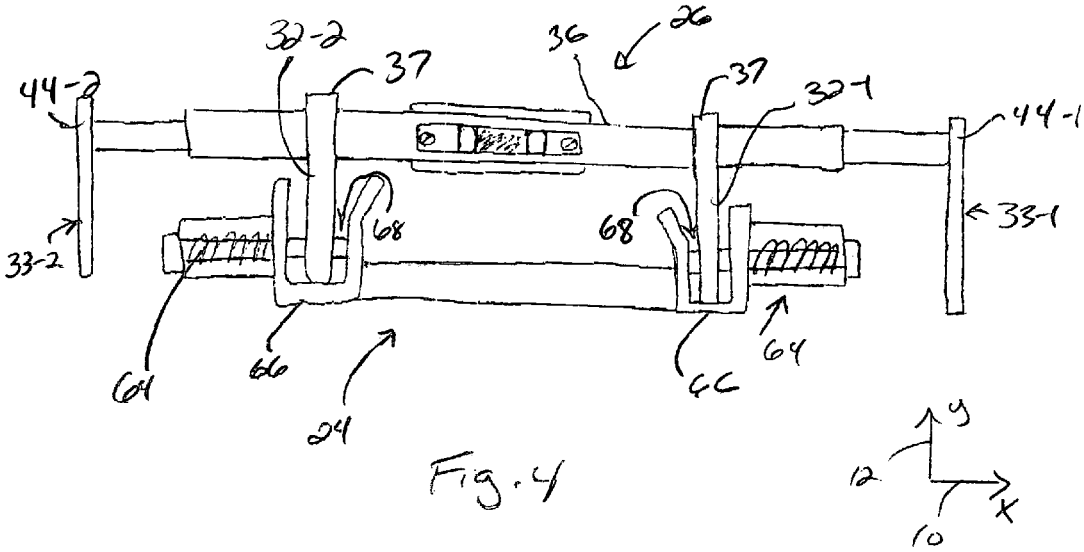
FIG. 4 illustrates attachment of the plow security device of FIG. 2 to a plow, according to one embodiment of the invention.

In FIG. 4, the operator engages the first mounting elements 32-2 of the plow security device 26 with the mounting portion 24 of the plow 22. For example, the operator places the first mounting elements 32-1, 32-2 within the corresponding brackets 66 and positions (e.g., releases) the pins 64 of the mounting portion 24 such that a first end 68 of each pin 64 enters or engages the openings 40 defined by the adaptor element 37.

Figure 5:
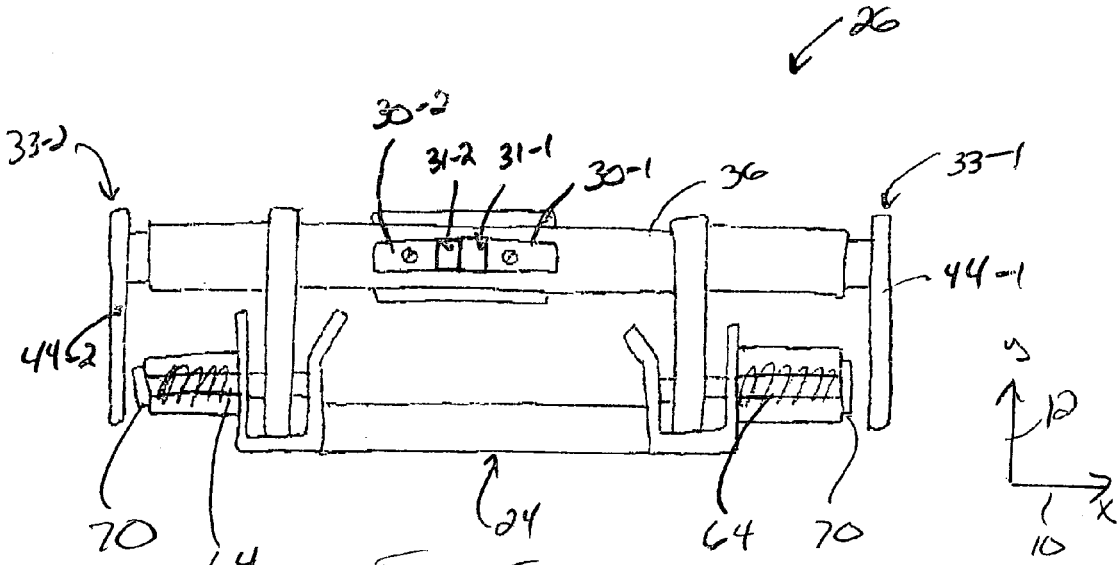
FIG. 5 illustrates attachment of the plow security device of FIG. 2 to a plow, according to one embodiment of the invention.

In FIG. 5, the operator positions the second mounting elements 33-1, 33-2 of the plow security device 26 in proximity to the mounting portion 24 of the plow 22. For example, the second mounting elements 33-1, 33-2 each include respective blocking elements 44-1, 44-2, such as steel plates. As the operator places the second mounting elements 33-1, 33-2 in proximity to the mounting portion 24 of the plow 22, the blocking elements 44-1, 44-2 position in proximity to respective second ends 70 of the attachment pins 64 of the plow mounting portion 24.

As indicated above, in the plow security device 26, the second mounting elements 33-1, 33-2 include fixation adaptors 30-1, 30-2. As indicated by FIG. 2, the fixation adaptors 30-1, 30-2 are configured as bars or rods having fixation portions 31-1, 31-2, each oriented at an angle relative to the long axis 35 of the fixation adaptors 30-1, 30-2. When an operator positions the second mounting elements 33-1, 33-2 of the plow security device 26 in proximity to the mounting portion 24 of the plow 22, such positioning orients the fixation adaptors 30-1, 30-2 adjacent each other, thereby allowing a user to secure the fixation adaptors 30-1, 30-2 to each other.

Figure 6:
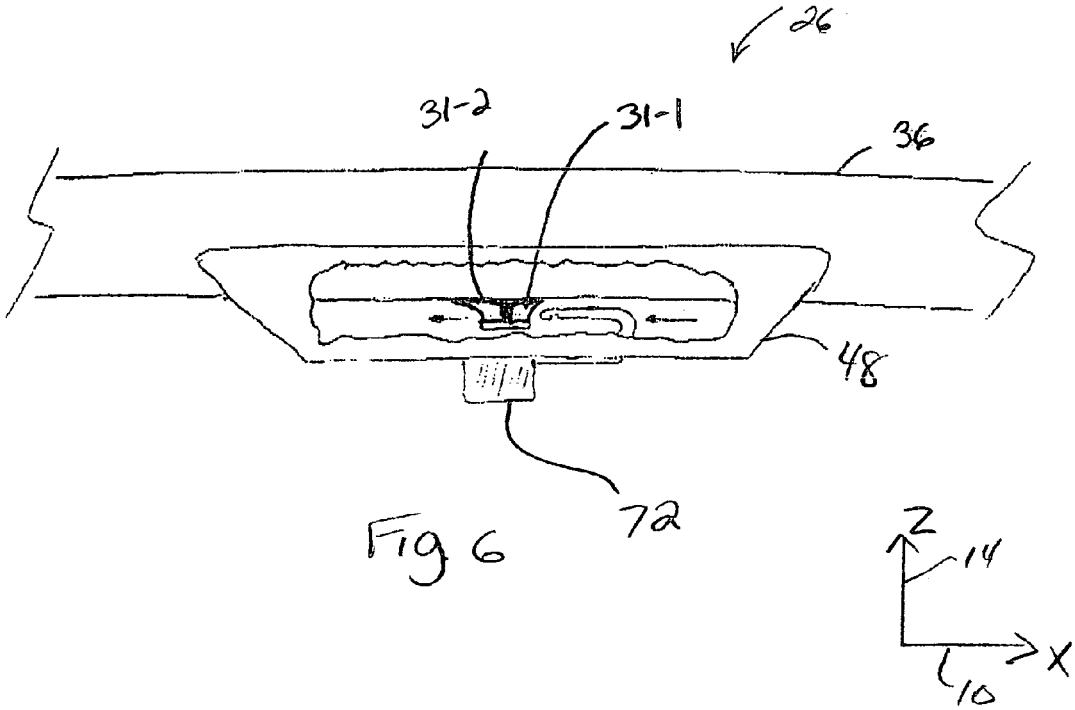
FIG. 6 illustrates securing of the plow security device of FIG. 2 to a plow, according to one embodiment of the invention.

As illustrated by FIG. 6, the operator couples or secures the fixation adaptors 30-1, 30-2 to each other using a lock 72, for example. By securing the fixation adaptors 30-1, 30-2, the operator secures the plow security device 26 to the plow 22 and limits access to the plow mounting portion 24 of the plow 22, thereby minimizing unauthorized use of the plow 22. For example, by securing the fixation adaptors 30-1, 30-2, the operator fixes the position of the blocking elements 44 of the second mounting elements 33-1, 33-2 relative to the second ends 70 of the pins 64 (e.g., secures the second mounting elements 33-1, 33-2 in a position in proximity to the mounting portion 24 of the plow 22). The blocking elements 44, therefore, limit retraction or positioning of the pins 64 (e.g., limits the ability for an unauthorized user to move the pins 64 along an x-axis direction 10) thereby limiting removal of the plow security device 26 from the plow mounting portion 24 by an unauthorized user. Furthermore, by coupling the fixation adaptors 30-1, 30-2 to each other, the operator blocks the couplers or brackets 66 of the plow mounting portion 24 with the housing 36 and first mounting portions 32-1, 32-2 of the plow security device 26. In such an arrangement, the plow security device 26 limits an unauthorized user access to the mounting portion 24 of the plow 22 (e.g. to the brackets 66) along a y-axis 12 orientation relative to the mounting portion 24.

As indicated above, FIG. 2 illustrates an arrangement of a plow security device 25 where the plow security device 26 is configured to secure a plow 22 having a pin-type coupling mechanism (e.g., a pair of retention pins) as part of the mounting portion 24. Different configurations of the plow security device 26, however, operate in conjunction with plows having alternately shaped or configured mounting portions.

Figure 7:
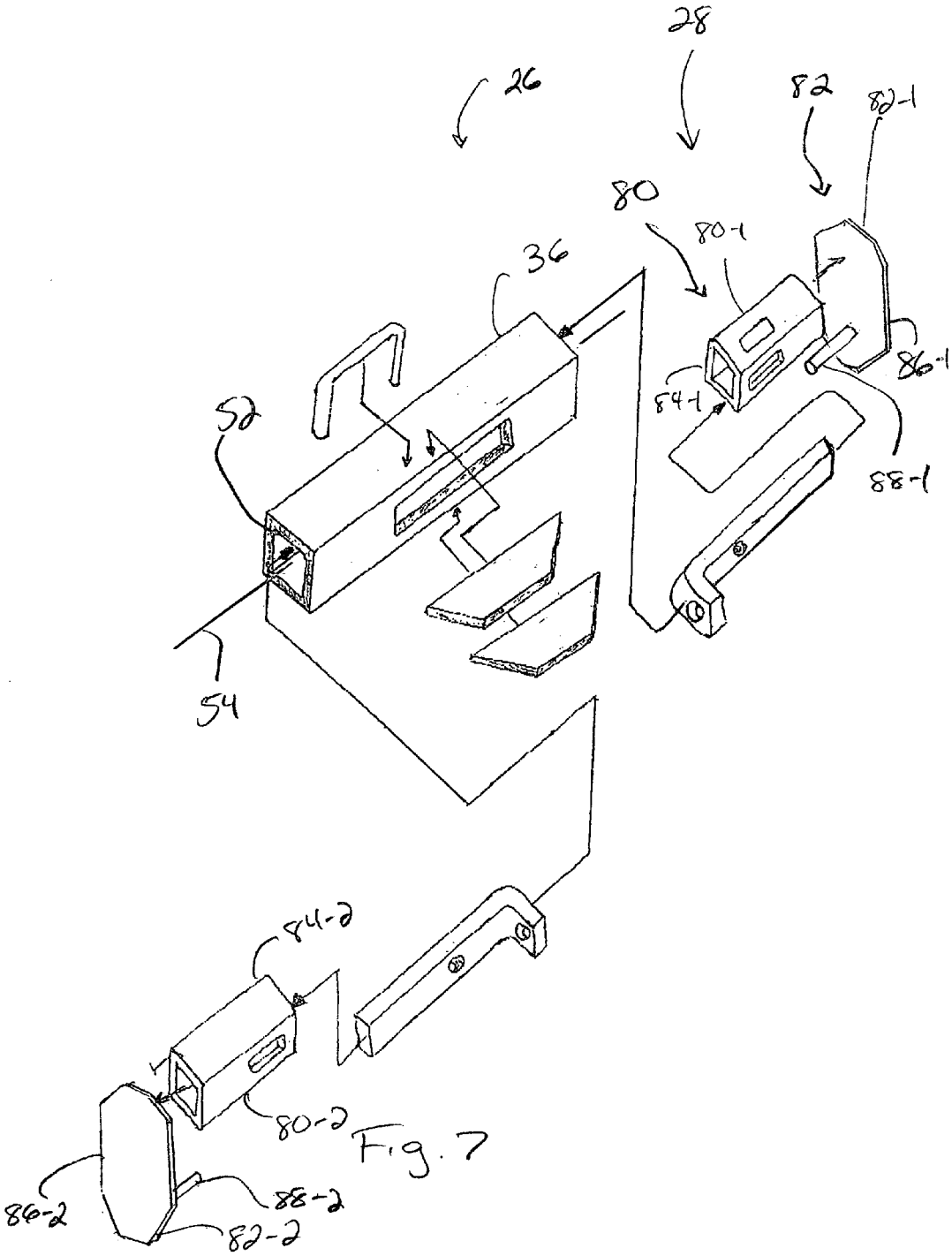
FIG. 7 illustrates an assembly view of a plow security system, according to one embodiment of the invention.
Figure 8:
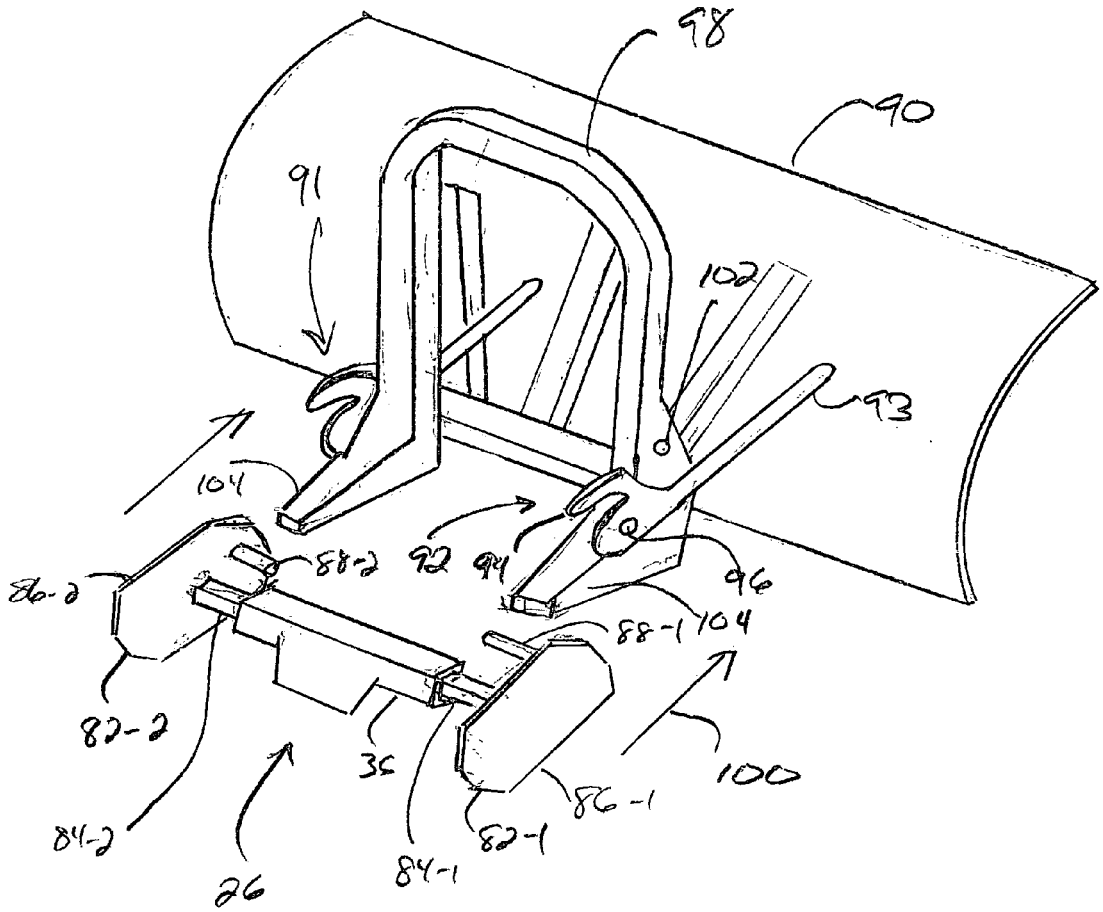
FIG. 8 illustrates attachment of the plow security device of FIG. 7 to a plow, according to one embodiment of the invention.
Figure 9:
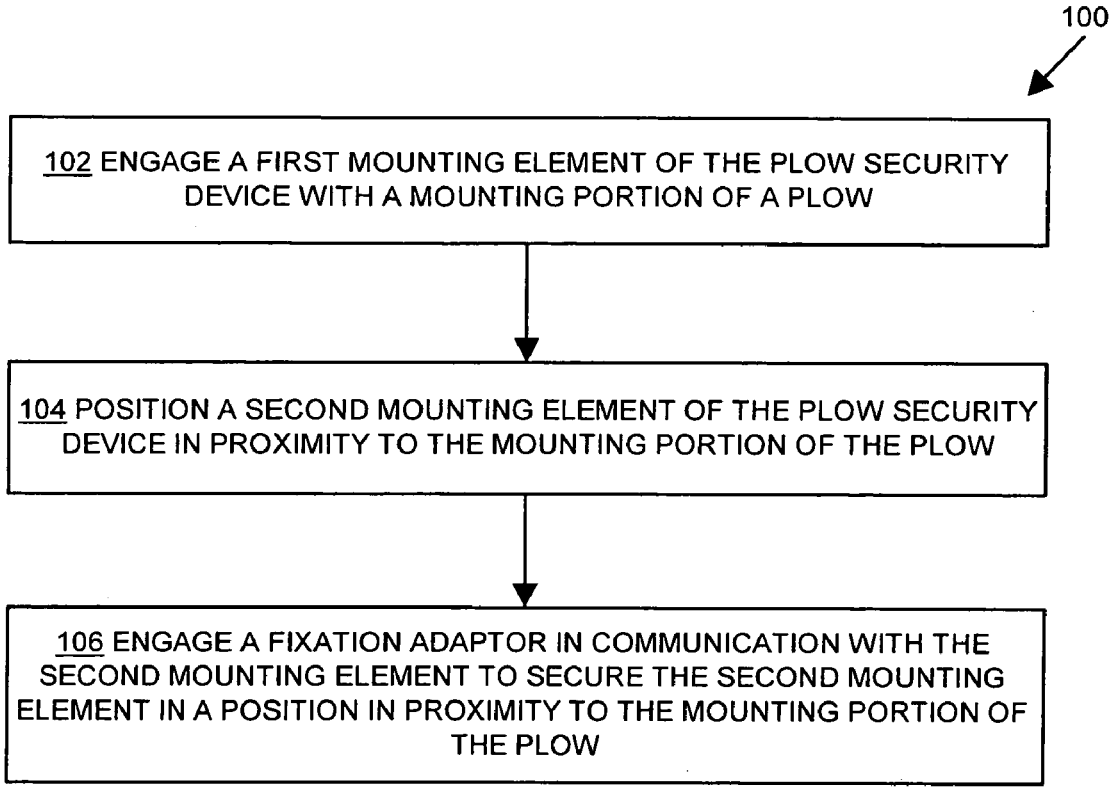
FIG. 9 is flowchart showing one embodiment of the invention.

FIG. 7 illustrates an arrangement of a plow security device 25 where the plow security device 26 is configured to secure a plow having a latching mechanism (e.g., a pair of spaced hooks or jaws pivotally coupled to the plow, such as illustrated in FIG. 8) as part of the mounting portion 24 of the plow. As illustrated, the plow security device 26 includes an attachment assembly 28 having a first mounting element 80 and a second mounting element 82.

The first mounting element 80 includes a jaw engagement member 84 configured to insert within an attachment jaw of a plow. The jaw engagement member 84, for example, is formed of a 1.5 inch square steel tube and inserts within the opening 52 defined by the housing 36 and slides within and relative to the opening 52 along the long axis 54 of the housing 36. As illustrated, in one arrangement, the first mounting element 82 also includes a fixation adaptor 30, configured as described above with respect to FIG. 2.

Returning to FIG. 7, the second mounting element 82 is formed of a blocking element 86 coupled to the jaw engagement member 84. For example, the blocking element 86, such as a steel plate, attaches to the jaw engagement member 84, via a plug weld. The blocking element 86 has a pin 88 configured to insert within an opening defined by the plow 22. As described below, when an operator secures the plow security device 26 to a corresponding plow, the jaw engagement member 84 and the blocking element 86 of the plow security device 26 limit unauthorized access to the mounting portion of a plow.

FIG. 8 illustrates attachment of the plow security device 26 to a plow 22 having a latching mechanism. For example, FIG. 8 illustrates installation of the plow security device 26 onto a plow 90, such as manufactured by Curtis Tractor Cab, Inc (Curtis Tractor Cab, Inc., Worcester, Mass.). The plow 90 includes a mounting portion 91 having a latch 92. The latch 92 includes, in one arrangement, a pair of spaced hooks or attachment jaws 94, each hook 94 pivotally coupled, via respective pivot members 96, to a plow frame assembly 98.

During installation, an operator slides the second mounting elements 82-1, 82-2 within the housing 36 of the plow security device 26 such that as the operator positions the plow security device 26 toward the mounting portion 91 along direction 100, the pins 88-1, 88-2 clear the plow frame assembly 98. The operator then engages the jaw engagement members 84-1, 84-2 with corresponding attachment jaws 94 of the mounting portion 91. In one arrangement, the jaw engagement members 84-1, 84-2 insert between the attachment jaws 94 and corresponding lateral frame portions 104.

To secure the plow security device 26 to the plow 90, the operator aligns the pins 88-1, 88-2 of the blocking elements 86-1, 86-2 with corresponding openings 102 defined by the plow frame assembly 98. The operator then slides the second mounting elements 82-1, 82-2 within the housing 36 of the plow security device 26 such that pins 88-1, 88-2 insert within the openings 102 of the plow 22 and the blocking elements 86-1, 86-2 position in proximity to the attachment jaw 94 of the plow. The operator then couples the fixation adaptors 30-1, 30-2 of the plow security device 26 to each other using a lock 72, for example.

By securing the fixation adaptors 30-1, 30-2, the operator secures the plow security device 26 to the plow 90 and limits access to the plow mounting portion 91 of the plow 90, thereby minimizing unauthorized use of the plow 22. For example, by coupling the fixation adaptors 30-1, 30-2 of the plow security device 26, the operator fixes the position of the blocking elements 86-1, 86-2 relative to the latch to secure the pins 88-1, 88-2 within the openings 102 defined by the frame 98. Such fixation limits (e.g., "blocks") rotation of a latch handle 93 to limit an unauthorized user from securing the latch 92 to an unauthorized vehicle. By coupling the fixation adaptors 30-1, 30-2 of the plow security device 26, the operator also fixes the jaw engagement members 84-1, 84-2 within corresponding attachment jaws 94 of the mounting portion 91. Such fixation limits (e.g., "blocks") rotation of the attachment jaws 94 of the latch 92 to limit an unauthorized user from coupling and securing the latch 92 to an unauthorized vehicle thereby minimizing or preventing unauthorized use or theft of the plow 90.

While this invention has been particularly shown and described with references to preferred embodiments thereof, it will be understood by those skilled in the art that various changes in form and details may be made therein without departing from the spirit and scope of the invention as defined by the appended claims.

For example, as illustrated in FIGS. 2 and 7, the housing 36 of the plow security device 26 includes a handle 50. For example, the handle 50 attaches to the housing 36 by way of a welded connection. The handle 50 provides a user or operator with a grasping location for the plow security device 26. The handle 50 allows the operator to align the plow security device 26 with the mounting portions 24 of a plow.

In one arrangement, an exterior surface of the plow security device 26 includes a protective coating, such as a powder coating. The powder coating aids in protecting plow security device 26 from corrosion as a result of exposure to the elements (e.g., when attached to a plow stored in an outside or outdoor location). In one arrangement, the powder coating has a relatively bright color, such as an orange color, that provides visibility to, and potentially discouraging, unauthorized users from accessing an associated plow.

Also as illustrated in FIGS. 2 and 7, the housing 36 of the plow security device 26 includes a fixation adaptor shield 48 having a first shield element 48-1 and a second shield element 48-2. Such illustration is by way of example only. In another arrangement, the fixation adaptor shield 48 includes a single shield element oriented in proximity to the fixation adaptor 30. In such an arrangement, the fixation adaptor 30 receives a shrouded padlock to secure the plow security device 26 to a plow. The single shield element limits the ability for an unauthorized user to destroy the shrouded padlock using a hammering device, such as a sledgehammer, while the configuration of the locking device as a shrouded padlock limits an unauthorized users access to the shrouded padlock via a set of lock cutters or bolt cutters.

What is claimed is:

1. A plow security device comprising:

an attachment assembly configured to engage a mounting portion of a plow and minimize attachment access to the mounting portion of the plow; and a fixation adaptor in communication with the attachment assembly, the fixation adaptor configured to secure the attachment assembly to the plow;

a housing coupled to the attachment assembly;

wherein the attachment assembly comprises:

a first mounting element coupled to the housing, the first mounting element configured to engage the mounting portion of the plow; and a second mounting element in movable communication with the housing, the second mounting element configured to position in proximity to the mounting portion of the plow;

wherein the first mounting element comprises an adaptor element coupled to the housing, the adaptor element defining an opening configured to receive a first end of an attachment pin of the plow; and the second mounting element comprises:

a support member in moveable communication with the housing, and a blocking element coupled to the support member, the blocking element configured to position in proximity to a second end of the attachment pin of the plow.

2. The plow security device of claim 1 wherein the housing comprises a fixation adaptor shield oriented in proximity to the fixation adaptor.

3. The plow security device of claim 2 wherein the fixation adaptor shield comprises a first shield element coupled to the housing and a second shield element coupled to the housing.

4. The plow security device of claim 3 wherein the second shied element couples to the housing such that the second shield element opposes the first shield element and orients substantially parallel to the first shield element.

5. The plow security device of claim 2 further comprising a shrouded padlock coupled to the fixation adaptor.

6. A plow security device comprising:

a first mounting element configured to engage a mounting portion of a plow; and a second mounting element configured to position in proximity to the mounting portion of the plow, the first mounting element and the second mounting element configured to minimize attachment access of the mounting portion of the plow;

a housing coupled to the first mounting element and in movable communication with the second mounting element, the second mounting element movable relative to the housing;

wherein the first mounting element comprises an adaptor element coupled to the housing, the adaptor element defining an opening configured to receive a first end of an attachment pin of the plow; and the second mounting element comprises:

a support member in moveable communication with the housing, and a blocking element coupled to the support member, the blocking element configured to orient in proximity to a second end of the attachment pin of the plow.

7. The plow security device of claim 6 further comprising a fixation adaptor in communication with the second mounting element, the fixation adaptor configured to secure the second mounting element in a position in proximity to the mounting portion of the plow.

8. The plow security device of claim 6 wherein the housing comprises a fixation adaptor shield oriented in proximity to a fixation adaptor in communication with the second mounting element, the fixation adaptor configured to secure the second mounting element in a position in proximity to the mounting portion of the plow.

9. The plow security device of claim 8 wherein the fixation adaptor shield comprises a first shield element coupled to the housing and a second shield element coupled to the housing, the second shied element opposing the first shield element and oriented substantially parallel to the first shield element.

10. The plow security device of claim 8 further comprising a shrouded padlock coupled to the fixation adaptor.

11. A plow security device comprising:

an attachment assembly configured to engage a mounting portion of a plow and minimize attachment access to the mounting portion of the plow; and a fixation adaptor in communication with the attachment assembly, the fixation adaptor configured to secure the attachment assembly to the plow;

a housing coupled to the attachment assembly;

wherein the attachment assembly comprises:

a first mounting element coupled to the housing, the first mounting element configured to engage the mounting portion of the plow; and a second mounting element in movable communication with the housing, the second mounting element configured to position in proximity to the mounting portion of the plow;

wherein the first mounting element comprises a jaw engagement member in moveable communication with the housing and configured to couple with a latch of the plow; and the second mounting element comprises a blocking element coupled to the jaw engagement member, the blocking element having a pin configured to insert within an opening defined by the plow, the blocking element configured to position in proximity to the latch of the plow.

12. A plow security device comprising:

a first mounting element configured to engage a mounting portion of a plow; and a second mounting element configured to position in proximity to the mounting portion of the plow, the first mounting element and the second mounting element configured to minimize attachment access of the mounting portion of the plow;

a housing coupled to the first mounting element and in movable communication with the second mounting element, the second mounting element movable relative to the housing wherein:

the first mounting element comprises a jaw engagement member in moveable communication with the housing and configured to couple with a latch of the plow; and the second mounting element comprises a blocking element coupled to the jaw engagement member, the blocking element having a pin configured to insert within an opening defined by the plow, the blocking element configured to position in proximity to the latch of the plow.

* * * * *